US006246855B1

(12) United States Patent
Gartstein et al.

(10) Patent No.: US 6,246,855 B1
(45) Date of Patent: Jun. 12, 2001

(54) APPARATUS FOR LOADING DRY XEROGRAPHIC TONER ONTO A TRAVELING WAVE GRID

(75) Inventors: Yuri Gartstein, Webster; Palghat S. Ramesh, Pittsford, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/583,020

(22) Filed: May 30, 2000

(51) Int. Cl.[7] ..... G03G 15/08
(52) U.S. Cl. ..... 399/281
(58) Field of Search ..... 399/272, 281, 399/282, 289, 292, 293, 266, 290, 291

(56) References Cited

U.S. PATENT DOCUMENTS

| | | | | |
|---|---|---|---|---|
| 4,558,941 | * | 12/1985 | Nosaki et al. . | |
| 4,647,179 | | 3/1987 | Schmidlin . | |
| 4,777,106 | | 10/1988 | Fotland et al. | 430/120 |
| 5,532,100 | | 7/1996 | Christy et al. | 430/120 |
| 5,717,986 | * | 2/1998 | Vo et al. | 399/291 |
| 5,842,094 | * | 11/1998 | Bruyndonckx et al. | 399/289 |
| 6,070,036 | * | 5/2000 | Thompson et al. | 399/266 |
| 6,112,044 | * | 8/2000 | Thompson et al. | 399/285 |
| 6,134,412 | * | 10/2000 | Thompson | 399/266 |

FOREIGN PATENT DOCUMENTS 61-073167 * 4/1986 (JP) .

* cited by examiner

*Primary Examiner*—Robert Beattty
(74) *Attorney, Agent, or Firm*—Lloyd F. Bean, II

(57) ABSTRACT

An apparatus for developing a latent image recorded on an imaging surface, including a housing defining a chamber storing a supply of developer material including toner and carrier, a donor member with an electrode array on it, spaced from the imaging surface, for transporting developer material on the surface thereof to a region opposed from the imaging surface; a closed-loop grid, spaced from said donor member, having an electrode array on the outer surface thereof, which faces said array on the donor member, said arrays including a plurality of spaced apart electrodes extending substantially across width of the surface of the grid and the donor; a magnetic roll for loading developer material onto said grid, and multi-phase voltage sources operatively coupled to said electrode arrays, the phase being shifted with respect to each other such as to create traveling electrodynamic wave patterns for moving toners along the surface of said electrode arrays, and with bias voltages controlling transfer of toners between said electrode arrays.

23 Claims, 7 Drawing Sheets

APPARATUS FOR LOADING DRY XEROGRAPHIC TONER ONTO A TRAVELING WAVE GRID

INCORPORATION BY REFERENCE

The following is specifically incorporated by reference, patent application Ser. No. 09/312,872, now U.S. Pat. No. 6,134,412 and Ser. No. 09/313,313, now U.S. Pat. No. 6,112,044 entitled, "A METHOD FOR LOADING DRY XEROGRAPHIC TONER ONTO A TRAVELING WAVE GRID" and "AN INTEGRATED TONER TRANSPORT/TONER CHARGING DEVICE", respectively.

This invention relates generally to a development apparatus for ionographic or electrophotographic imaging and printing apparatuses and machines, and more particularly is directed to an apparatus and method for loading dry xerographic toner onto a traveling wave grid or donor member, or for development onto a photoreceptor.

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. In the application of the toner to the latent electrostatic images contained on the charge-retentive surface, it is necessary to transport the toner from a developer housing to the surface. A limitation of conventional xerographic development systems, including both magnetic brush and single component, is the inability to deliver toner (i.e. charged pigment) to the latent images without creating large adhesive forces between the toner and the conveyor on which the toner rests and which transports the toner to latent images. As will be appreciated, large fluctuation in the adhesive forces that cause the pigment to tenaciously adhere to the carrier severely limits the sensitivity of the developer system thereby necessitating higher contrast voltages forming the images. Accordingly, it is desirable to reduce the large adhesion particularly in connection with latent images formed by contrasting voltages.

In order to minimize adhesive forces, it has been found that a toner conveyor including means for generating traveling electrostatic waves which can constantly move the toner about the surface of the conveyor with minimal static contact therewith.

Traveling waves have been employed for transporting toner particles in a development system, for example U.S. Pat. No. 4,647,179 to Schmidlin which is hereby incorporated by reference. In that patent, the traveling wave is generated by alternating voltages of three or more phases applied to a linear array of conductors placed abut the outer periphery of the conveyor. The force F for moving the toner about the conveyor is equal $QE_t$ where Q is the charge on the toner and $E_t$ is the tangential field supplied by a multi-phase AC voltage applied to the array of conductors.

In that Patent and in other typical approaches, toner is presented to the traveling wave grid by means of a magnetic brush which is rotated in the same direction as the traveling wave propagates. This is suppose to give an initial velocity to the toner particles which enables toner having much lower velocities to catch the wave. Increase of the traveling wave's phase velocity is therefore limited by the brush rotation speed making the loading less efficient. Another limitation on the loading arises because of the amount of toner exposed to stripping- the magnetic brush tips tend to be sparse for large brush spacing and the stripping field on the traveling wave grid decreases exponentially with distance from the grid surface. The methods to increase the amount of toner loaded to the grid (with the magnetic brush in this mode) include speeding up the magnetic roll, decreasing the spacing, increasing the loading zone length, and increasing the number of rolls. All these approaches impose additional requirements on the system thereby limiting their applicability, and will mechanically wear the traveling wave device at the loading zone (grinding at a stationary loading zone on the grid).

SUMMARY OF THE INVENTION

Briefly, in the present invention, the impact of the above problems is significantly reduced and the overall loading efficiency is increased by separating the function of toner extraction from the function of toner transport toward the development zone. This is achieved by introducing an additional loading traveling wave grid(s) between the magnetic brush and the main transport traveling wave grid. The loading grid and the transport grid can be operated under different conditions (such as traveling wave's frequency and amplitude) more appropriate for their functionality. Electrostatic transfer of toners from the loading grid(s) to the transport grid is driven by the voltage applied between them. An extra advantage is gained by miniaturizing the loading grids (minigrids) so that several (many) of them can be used to efficiently strip toner from a single magnetic brush and transfer it to the transport grid. Loading grids may be coated with a more wear-resistant coating and are less expensive to replace than the main transport grid.

Inasmuch as the art of electrophotographic printing is well known, the various processing stations employed in the printing machine will be shown hereinafter schematically and their operation described briefly with reference thereto.

Figure 1:
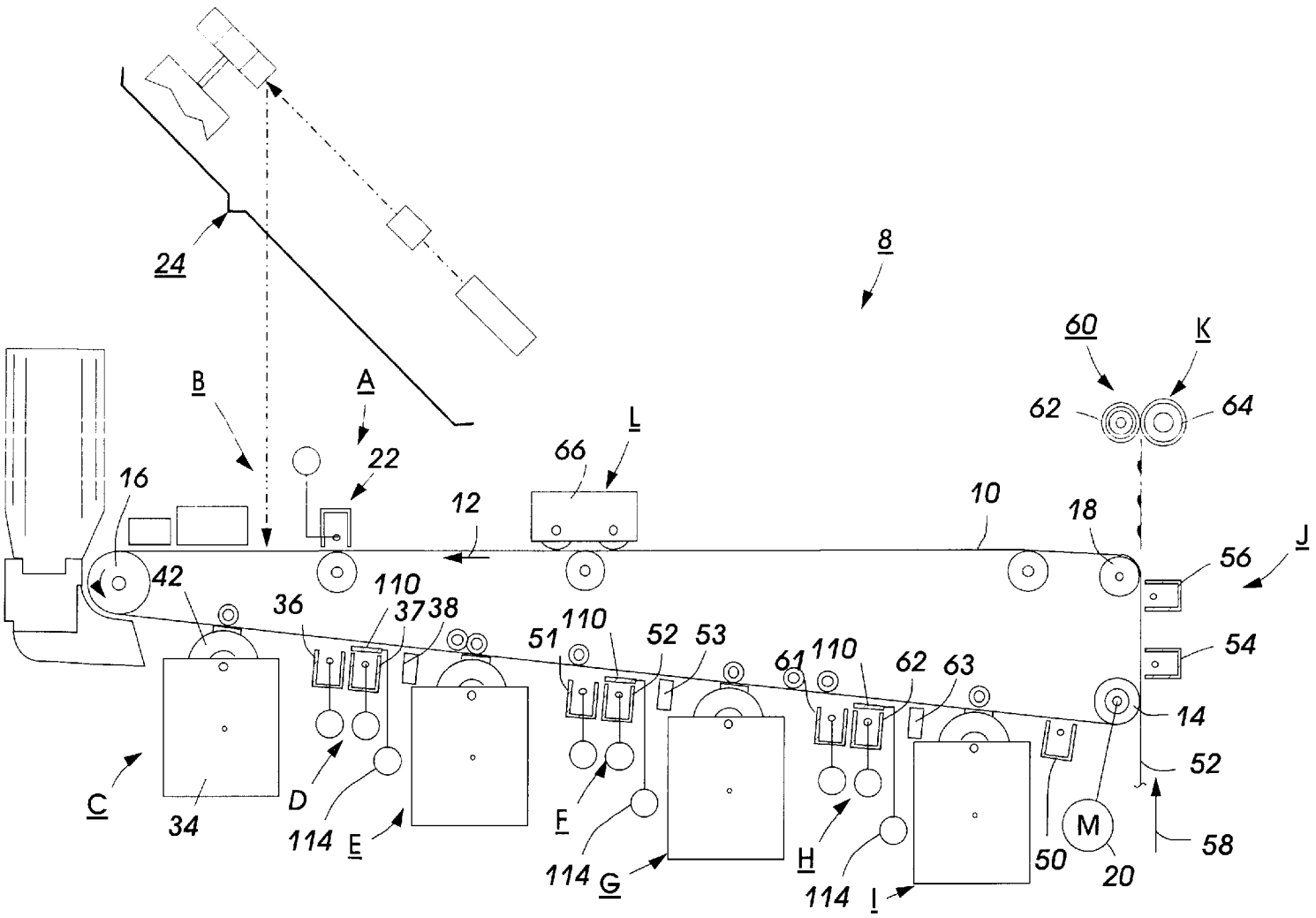
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention.

After passing through the first exposure station B, the now exposed image area passes through a first development station C which is identical in structure with development system E, G, and I. The first development station C deposits a first color, say black, of negatively charged toner 76 onto the image area. That toner is attracted to the less negative sections of the image area and repelled by the more negative sections. The result is a first toner powder image on the image area.

For the first development station C, development system 34 includes a flexible donor belt 42 having groups of electrode arrays near the surface of the belt for transferring toner to the development zone.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged by the first recharging device 36, the image area passes to the second recharging device 37.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37, and recharging devices 51 and 52.

After passing through the third recharging station, the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction of 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64, the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 2:
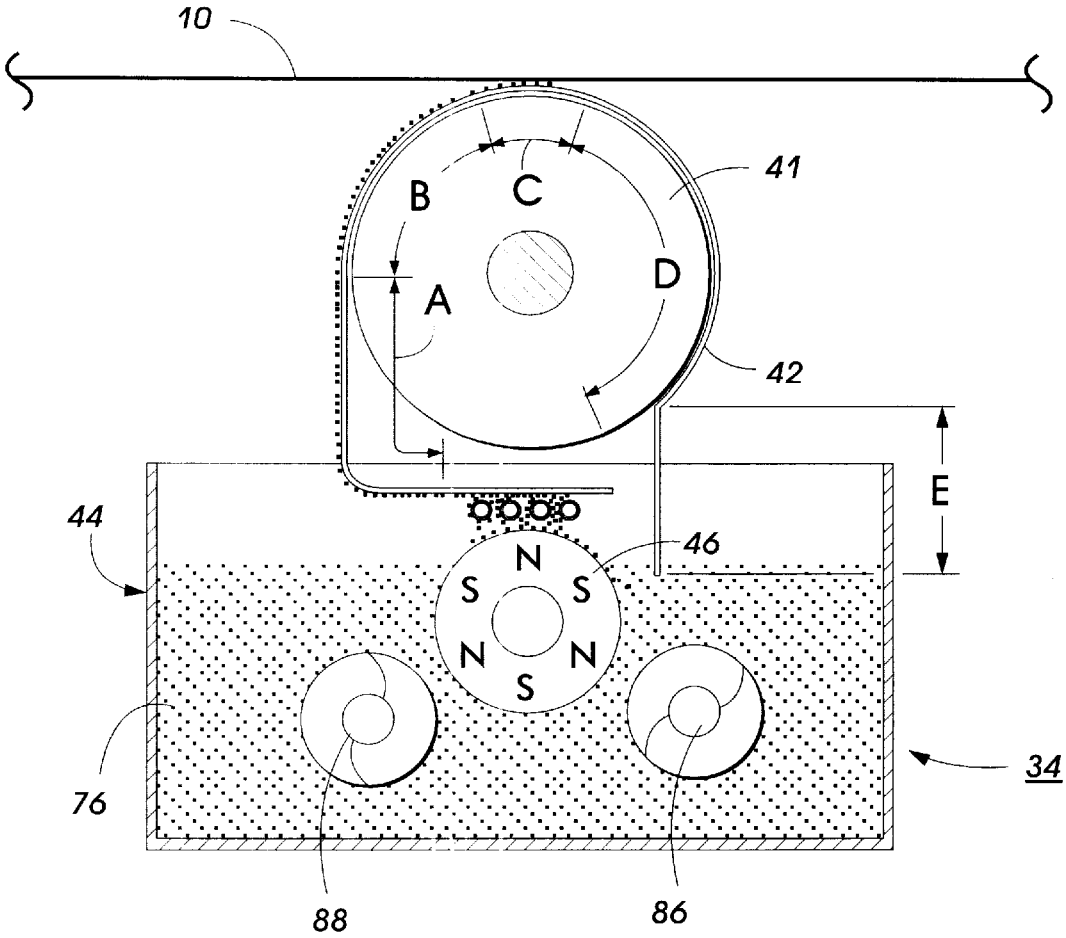
FIG. 2 is a schematic elevational view showing one embodiment of development apparatus of the present invention used in the FIG. 1 printing machine.

Turning to FIG. 2, which illustrates the development system 34 in greater detail, development system 34 includes a housing 44 defining a chamber 76 for storing a supply of developer material therein. Donor belt 42 is mounted on stationary roll 41 and belt portion 43 is mounted adjacent to magnetic roll 46.

It should be noted that donor belt can be a donor roll as known in art, such as a HSD/SED roll.

Figure 3:
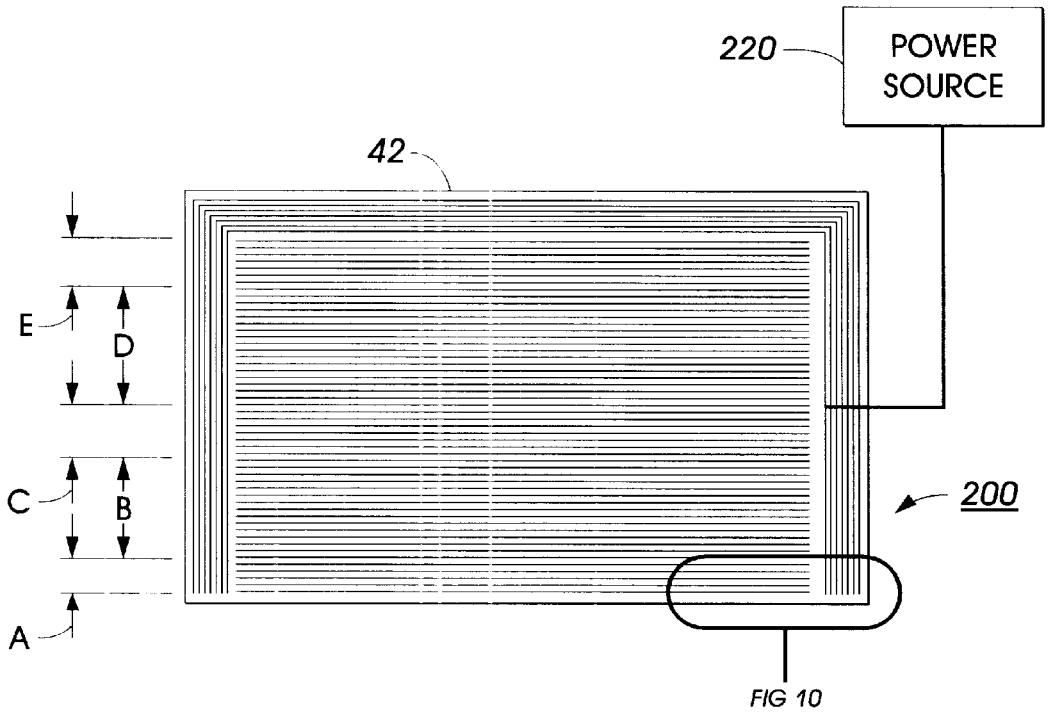
FIGS. 3 and 4 are top view of a portion of the flexible donor belt.
Figure 4:
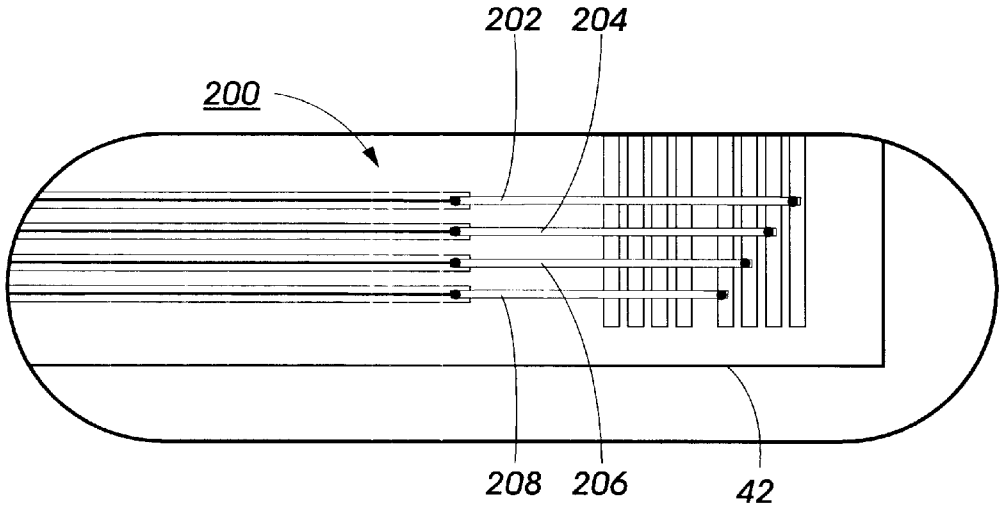

Donor belts 42 comprise a flexible circuit board having finely spaced electrode array 200 thereon as shown in FIGS. 3 and 4. The electrode array 200 has a four phase grid structure consisting of electrodes 202, 204, 206, and 208 having a voltage source and a wave generator operatively connected thereto in the manner shown in order to supply the proper wave form in the appropriate electrode area groups A–E.

Electrode array 200 has group areas A–E in which each group area is individually addressable to perform the function of: (A) Loading toner onto the array from the housing; (B) Transporting toner to the development zone; (C) Developing the image in the development zone; (D) Transporting toner from the development zone, and (E) Unloading toner from the array back into the housing. Electrode array group areas A–E connected to the voltage source 220 via wave generator develop a traveling wave pattern. The electrodes in array group area (A) picks up the toner from the housing and transports it via the electrostatic wave set up by wave generator. The electrostatic field forming the traveling wave pattern pushes the toner particles about the surface of the donor belt from the developer sump 76 to the belt 10 where they are transferred to the latent electrostatic images on the belt 10. Thereafter, the remaining (untransferred) toner is moved by electrode array group area D to electrode group area E where remaining toner is unloaded off the belt.

Figure 6:
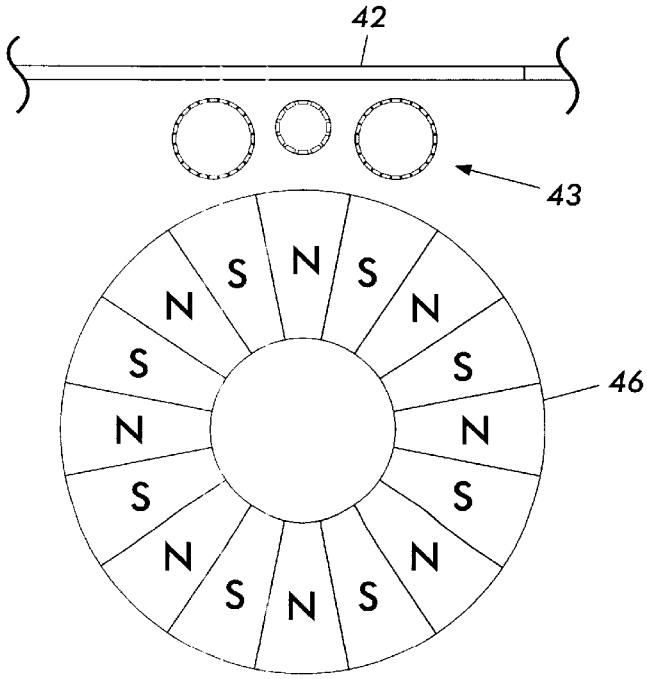
Figure 7:
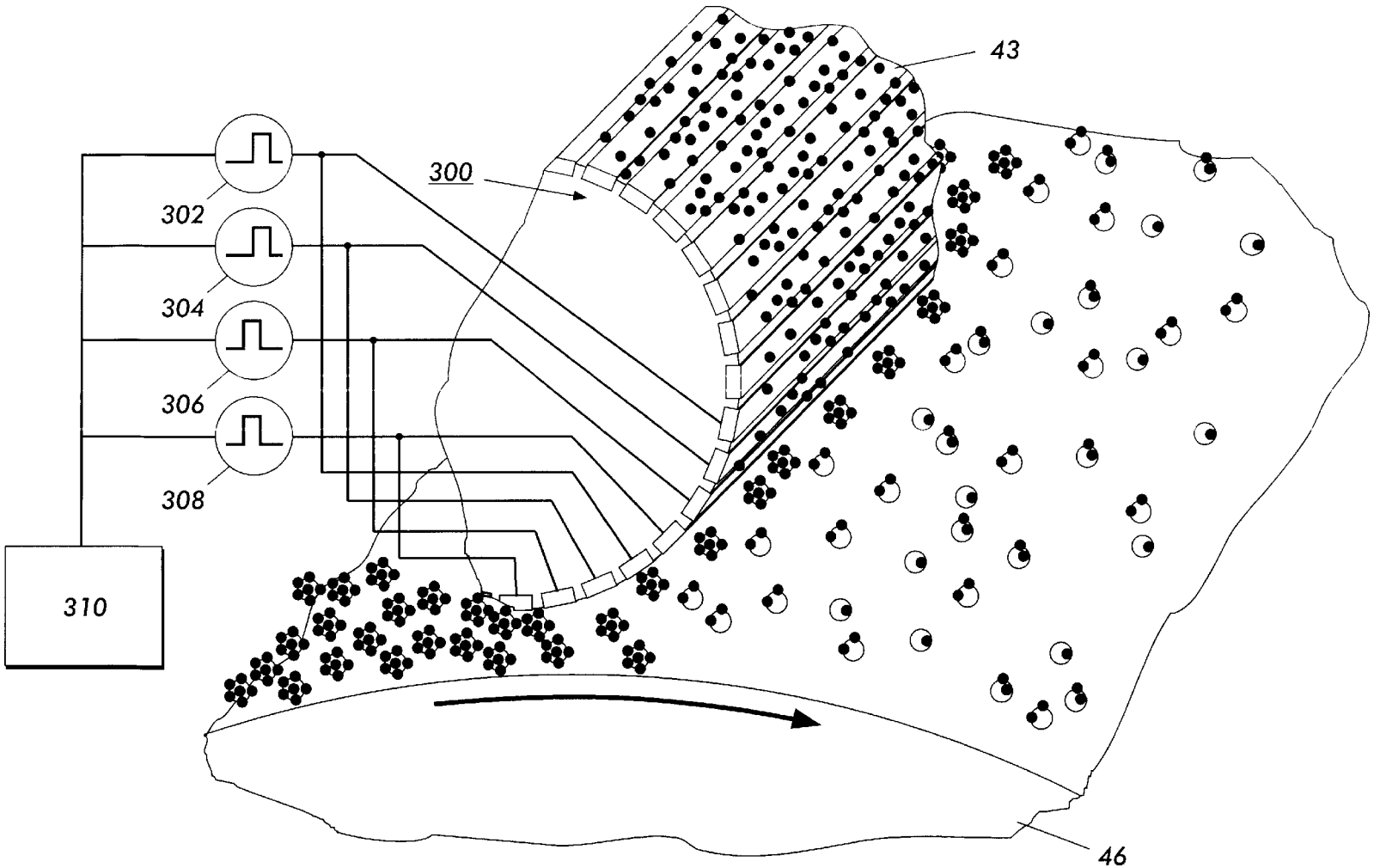
FIG. 7 schematically shows toner extraction from the magnetic brush by a loading grid.

The present invention employs closed loop loading traveling wave minigrids 43 spaced between donor belt portion and magnetic roll 46. The minigrids 43 extend across donor belt and magnetic roll, are traveling wave grids essentially very similar to 42, and comprise a flexible circuit board having finely spaced electrode array 300 thereon as shown in FIG. 7. The typical spacing between electrodes is between 25 and 100 microns. The electrode array 300 has a four phase grid structure consisting of electrodes 302, 304, 306, and 308 having a voltage source and a wave generator operatively connected thereto in the manner shown in FIG.7. A voltage source via wave generator 310 develops a traveling wave pattern. The electrostatic field forming the traveling wave pattern drives the toner particles along the surface of the loading grids 43. Extraction of toners from the magnetic brush 46 onto the loading grids(s) 43 occurs by virtue of the electrostatic voltage bias between them (it may also have some AC component to it). It is Important that both geometrical dimensions and electrodynamic driving patterns for the electrodes of grids 42 and 43 can be made independent of each other. Therefore, the loading traveling wave minigrids 43 may operate under different conditions than the "main", transport, traveling wave grid 42. The traveling wave pattern may have different frequencies, amplitudes, and waveforms. For instance, we mentioned above that the difference between toner initial velocities and the transporting wave's phase velocity prevents toners from effectively catching the wave. The wave's phase velocity is proportional to its operational frequency. With the loading grid's frequency being lower than the transport grid's frequency, toners have a better chance to catch the wave of grid 43. After being accelerated to that level, they could be better transferred to the wave on grid 42. (In fact, if the disparity between toner's initial velocity after leaving the brush 46 and the desired velocity on the grid 42 is too large, the acceleration process could include a cascade of intermediate loading grids rather than just two transfers in FIGS. 5 and 6.) Operating the large transport grid at higher voltage amplitudes could be expensive, for smaller loading grids. However, the traveling wave's voltage amplitude can be increased, thereby improving its field penetration into the magnetic brush and its toner extraction efficiency. Typically, the frequencies involved are in the range of hundreds of Hz to thousands of Hz, for example 100 hz to 3000 hz, and the peak-to-peak amplitudes are in the range of several hundred volts, for example 100 volts to 900 volts.

Figure 5:
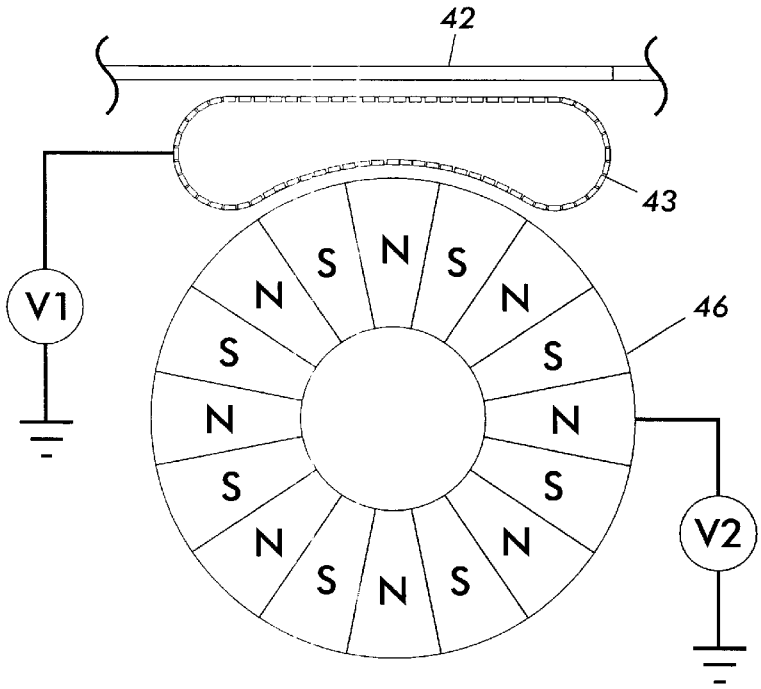
FIGS. 5 and 6 are embodiments of the toner loading zone and minigrids of the present invention.

The extraction of toners from the magnetic roll onto loading minigrids 43 is also controlled by the potential difference V2–V1 (it might have an AC component too). The transfer of toners from the loading grids onto the transport grid is controlled by the potential difference between V1 and the average potential of grid 42 (with or without an AC component) and is essentially analogous to scavengeless development. The magnitudes of these bias voltages depend on the spacings between the grids and the magnetic brush and can reach several hundred volts. The loading grids in FIGS. 5 and 6 are closed-loop system of electrodes on the outer perimeter with a conventional traveling wave driving arrangement. The geometrical flexibility of the grids allows various geometrical implementations. The main difference between FIGS. 5 and 6 is that in FIG. 6, a few loading minigrids are used instead of one larger loading grid. This is intended to decrease self-scavenging by magnetic roll from the loading minigrids 43 in FIG. 6 (which might still be in effect in the configuration of FIG. 5) and also to improve the toner migration in the vicinity of the contact between the magnetic brush and the loading grid. Of course, the number and size of the minigrids is determined to optimize the performance.

Typically, the size of minigrids 43 in FIG. 6 is on the order of millimeters. Note that for the traveling wave's wavelength of 600–800 microns (with 75 to 100 micron width and spacing between electrodes), the circumference of, e.g., a 2 mm radius minigrid would contain 16–21 wavelengths. Typical diameters of the minigrids are between 1 mm to 1 cm. Typically, the minigrid is spaced between 300 microns or less from the donor member and the minigrid is spaced between 100 microns or less from the loading member.

Figure 8:
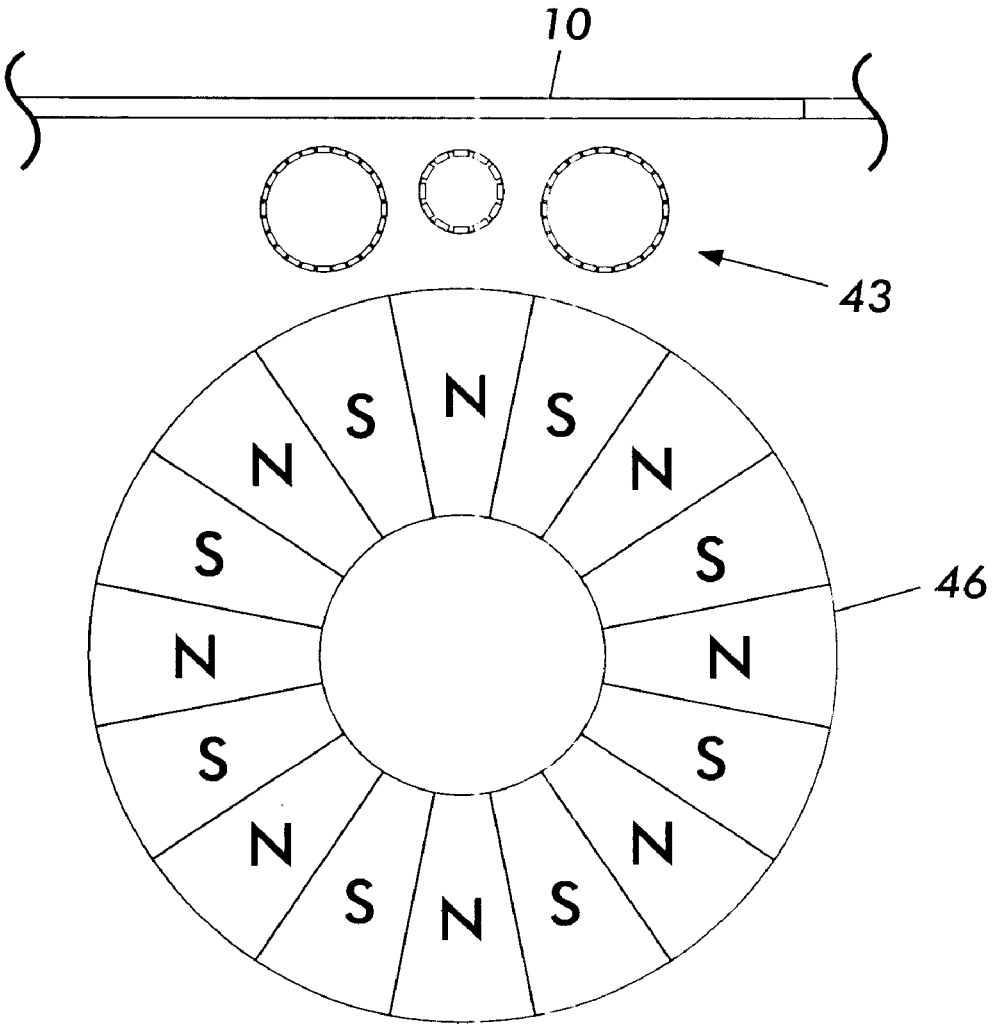
FIG. 8 is a schematic elevational view showing another embodiment of development apparatus of the present invention.

Depending on system requirements, a direct development from the loading minigrids onto a photoreceptor may also be possible eliminating the transporting grid 42, as shown in FIG. 8. Note that the 3 minigrids in FIGS. 6 and 8 are shown to have somewhat different diameters. This is intended to schematically emphasize the geometric flexibility of the minigrids. They may have even an elongated shape so that they contact the flat photoreceptor and round magnetic brush at some desired grid-independent spacings to the magnetic brush and to the photoreceptor. Thereby, much more efficient collection can be achieved with an effectively increased development zone (but still with a single magnetic brush).

One may think of these minigrids as generalized HSD ("hybrid scavengeless development") wires that eventually deliver "scavengeless" powder cloud to the image on the photoreceptor.

There is a difference in operation of loading grids in FIG. 6, a transport grid as opposed to a photoreceptor as in FIG. 8. When minigrids are actually used for loading onto the transport grid, the voltage V1 is intended to almost fully develop toners onto the transport grid.

In FIG. 8, however, with the photoreceptor 10, the toners on the "loading" grids, depending on the image voltage, can be in a cycling (re-entrant) mode, where once loaded by a magnetic roll, they will come in the interaction with the magnetic roll after encircling the grid.

The preferred directionality of the traveling wave's propagation on the transport grid 42 is with the traveling wave's propagation on loading grids 43. Or, when loading grids 43 are adjacent to the photoreceptor, then traveling wave's propagation direction is in the direction of the motion of the photoreceptor.

Figure 9:
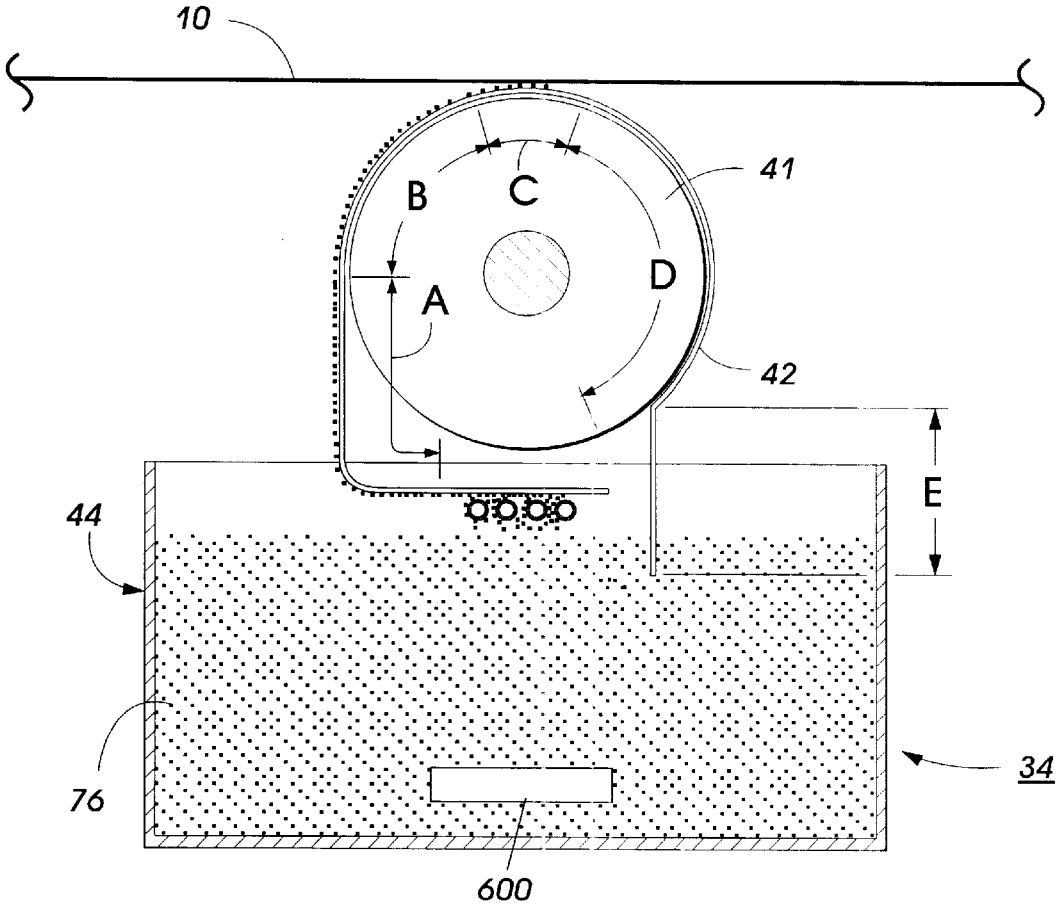
FIG. 9 shows the invention with the loading means being a fluidized bed.

FIG. 9 shows the invention with the loading means being a fluidized bed. In operation, air plenum 600 fluidizes the toner in chamber 76; the grid is spaced from the bed or can be partly immersed in the fluidized bed. Efficient means for fluidizing toner and charging the particles within the fluidized bed are disclosed in U.S. Pat. Nos. 4,777,106 and 5,532,100, which are hereby incorporated by reference.

An advantageous feature of the present invention is in the absence of intimate contact between the magnetic brush and the transport traveling wave grid. Since the efficiency of the toner loading from magnetic brush 46 directly onto traveling wave grid 42 is strongly dependent on the frequency of the transporting wave (and may be affected by the material properties) while the desired frequency of the latter can be determined by purely transport considerations (like, e.g., the process speed), the flexibility and latitude of the overall system should be substantially increased if the loading and transport steps are separated. The separation of the loading and transport steps may serve other goals as well. For instance, the wear of the main transport grid due to the interaction with the magnetic brush will be eliminated, and the minigrid will be less costly to replace. Also, the accidental appearance of the carriers on the transport grid and further in the development zone will be prevented.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a chamber storing a supply of developer material including toner;

a donor member, spaced from the imaging surface, for transporting developer material on the surface thereof to a region opposed from the imaging surface;

means for loading developer material onto a grid;

said grid, spaced from in between said donor member and said loading means; said grid having electrode arrays on the outer surface thereof, said arrays including a plurality of spaced apart electrodes extending across substantial width of the surface of the grid, said grid comprises a closed loop; and a multi-phase voltage source operatively coupled to said electrode arrays, the phase being shifted with respect to each other such as to create traveling electrodynamic wave patterns for moving toners along the surface of said electrode array and with bias voltages for moving toners between said loading means, said grid and said donor member.

2. The apparatus of claim 1 multi-phase voltage sources operatively coupled to said electrode arrays, the phase being shifted with respect to each other, such as to create traveling electrodynamic wave patterns for moving toners along the surface of said electrode arrays, wherein said closed loop has a diameter ranging from 1 mm to 1 cm.

3. The apparatus of claim 2, wherein said electrodes array have a spacing between 25 and 100 microns between each electrode in said electrode arrays.

4. The apparatus of claim 1, further comprising a plurality of said grid spaced in between said donor member and said loading means.

5. The apparatus of claim 1, wherein said grid has an operating frequency ranging from 100 hz to 3000 hz.

6. The apparatus of claim 1, wherein said grid has an operating voltage ranging from 100 volts to 900 volts.

7. The apparatus of claim 1, wherein said loading means comprises a magnetic brush.

8. The apparatus of claim 1, wherein said loading means comprises a fluidized bed.

9. The apparatus of claim 1, wherein said grid is spaced between 300 microns or less from said donor.

10. The apparatus of claim 1, wherein said grid is spaced between 100 microns or less from said loading means.

11. The apparatus of claim 1, wherein said traveling electrodynamic wave pattern has a wavelength between 100–800 microns.

12. The apparatus of claim 1, further including a transporting traveling wave grid on the donor member facing said loading grid(s), said grids being driven by independent multi-phase voltage sources that can be operated with different frequencies, amplitudes and waveforms.

13. An apparatus for developing a latent image recorded on an imaging surface, comprising:

a housing defining a chamber storing a supply of developer material, including toner;

a grid member, including a plurality of grids for transporting developer material to a region opposed from the imaging surface, said grid having an electrode array on the outer surface thereof, said array including a plurality of spaced apart electrodes extending substantially across the width of the surface of the grid;

means for loading developer material onto said grid, said loading means being spaced from said grid, each of plurality of grids comprises a closed loop; and a multi-phase voltage sources operatively coupled to said electrode arrays, the phase being shifted with respect to each other such as to create traveling electrodynamic wave patterns along the surface of said electrode arrays for moving toners from said loading means to said imaging member.

14. The apparatus of claim 13, wherein said closed loop has a diameter ranging from 1 mm to 1 cm.

15. The apparatus of claim 13, wherein said electrodes array has a spacing between 75 and 100 microns between each electrode in said electrode arrays.

16. The apparatus of claim 13, wherein each of plurality of grids are spaced in between said donor member and said loading means.

17. The apparatus of claim 13, wherein said traveling electrodynamic has an operating frequency ranging from 100 hz to 1200 hz.

18. The apparatus of claim 13, wherein said grid member has an operating voltage ranging from 100 volts to 900 volts.

19. The apparatus of claim 13, wherein said loading means comprises a magnetic brush.

20. The apparatus of claim 13, wherein said loading means comprises a fluidized bed.

21. The apparatus of claim 13, wherein said grid member is spaced between 100 microns or less from said donor.

22. The apparatus of claim 13, wherein said grid member is spaced between 100 microns or less from said loading means.

23. The apparatus of claim 13, wherein said traveling electrodynamic wave patterns have a wavelength between 600–800 microns.

* * * * *